US008376591B2

(12) United States Patent
Jurik

(10) Patent No.: US 8,376,591 B2
(45) Date of Patent: Feb. 19, 2013

(54) LENS SLIDE FOR AN AUTOMATED LUMINAIRE

(75) Inventor: Pavel Jurik, Postredni Becva (CZ)

(73) Assignee: ROBE Lighting s.r.o., Postredni Becva (CZ)

( * ) Notice: Subject to any disclaimer, the term of this patent is extended or adjusted under 35 U.S.C. 154(b) by 198 days.

(21) Appl. No.: 12/749,660

(22) Filed: Mar. 30, 2010

(65) Prior Publication Data

US 2010/0246196 A1 Sep. 30, 2010

Related U.S. Application Data

(60) Provisional application No. 61/165,274, filed on Mar. 31, 2010.

(51) Int. Cl.
*F21V 14/06* (2006.01)

(52) U.S. Cl. ..... 362/331; 362/268; 362/270; 362/277

(58) Field of Classification Search ..... 362/268, 362/270, 271, 277, 311.01, 319, 326, 331
See application file for complete search history.

(56) References Cited

U.S. PATENT DOCUMENTS

| | | | | |
|---|---|---|---|---|
| 4,462,067 | A * | 7/1984 | Altman | 362/268 |
| 5,295,056 | A * | 3/1994 | Peck | 362/267 |
| 5,404,283 | A * | 4/1995 | Yantz et al. | 362/267 |
| 6,809,869 | B2 * | 10/2004 | Hough | 359/626 |
| 6,834,982 | B2 * | 12/2004 | Dedoro | 362/268 |
| 2003/0076682 | A1 * | 4/2003 | Tanaka et al. | 362/280 |
| 2009/0303723 | A1 * | 12/2009 | Cavenati et al. | 362/268 |

* cited by examiner

*Primary Examiner* — Laura Tso

(57) ABSTRACT

The described systems 200 provides a simplified slide system for longitudinal movement of optical light modulators 102 for automated luminaires 12 employing expansion and contractions slots 125, 126 which allow for precise smooth movement over a range of temperatures.

14 Claims, 6 Drawing Sheets

LENS SLIDE FOR AN AUTOMATED LUMINAIRE

RELATED APPLICATION(S)

This application is a utility filing claiming priority of provisional application 61/165,274 filed on 31 Mar. 2010.

TECHNICAL FIELD OF THE INVENTION

The present invention generally relates to an automated luminaire, specifically to the configuration and control of the movement of lenses within such a luminaire.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will typically provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The beam pattern is often provided by a stencil or slide called a gobo which may be a steel, aluminum or etched glass pattern. The products manufactured by Robe Show Lighting such as the ColorSpot 700E are typical of the art.

FIG. 1 illustrates a multiparameter automated luminaire system 10. These systems commonly include a plurality of multiparameter automated luminaires 12 which typically each contain on-board a light source (not shown), light modulation devices, electric motors coupled to mechanical drives systems and control electronics (not shown). In addition to being connected to mains power either directly or through a power distribution system (not shown), each luminaire is connected is series or in parallel to data link 14 to one or more control desks 15. The luminaire system 10 is typically controlled by an operator through the control desk 15.

FIG. 2 illustrates a prior art automated luminaire 12. A lamp 21 contains a light source 22 which emits light. The light is reflected and controlled by reflector 20 through an aperture or imaging gate 24. The resultant light beam may be further constrained, shaped, colored and filtered by optical devices 26 which may include dichroic color filters, goboes, rotating goboes, irises, framing shutters, effects glass and other optical devices well known in the art. The final output beam may be transmitted through output lenses 28 and 29 which may form a zoom lens system. Lenses 28 and 29 may individually and separately be constrained to move along the optical axis on slide rails 30 and 32 so as to change the separation of lenses 28 and 29 and the relative position of the lenses to aperture 24 and optical device(s 26. The movement of the lenses may change the effective focal length of the combination and therefore the image focus and image magnification. By adjusting the positions of the lenses the user can select a desired image size and then control the sharpness or focus of that image. The friction or dampening on the movement of lenses 28 and 29 and their interaction with slide rails 30 and 32 is critical to the smooth and accurate operation of the luminaire 12. If the friction is too high then the lenses 28 and 29 may jam or stick on the rail(s) 30 or 32 and movement may be jerky. Additionally excess friction will cause hysteresis problems where a lens 28, 29 will be positioned differently when moving to a preset position in one direction 27 or 31 than when it moves to that same position from the opposite direction 31 or 27 respectively. Such jerky movement and hysteresis will be manifested as poor image quality in the projected beam or noticeable and distracting jumps in the focus and size of the projected image/beam. It is also important that the friction is not too low as that may cause overshoot or wobbling of the lenses 28, 29 as they move. As with many mechanical systems a critical amount of friction or dampening is key to smooth, controlled movement.

FIG. 3 illustrates a prior art mechanism used to control the movement of a lens assembly 100 along the optical axis of an automated luminaire. Lens 102 is rigidly attached to a lens carrier 104. Lens carrier 104 rides on a rail 112 such that lens carrier 104 may slide along cylindrical rail 112 and the lens 102 may be positioned as desired along the optical axis through connection 114 with belt 116. Belt 114 is moved by the rotation of driven pulley 108 and runs on idler 110. In the prior art embodiment illustrated there is a transverse circular hole (not shown in FIG. 3) through lens carrier 120 of as diameter slightly larger than that of the rail 112 so that the carrier moves freely on the rail with the hole acting as a friction beating. It is important that movement is constrained to the optical axis only as any movement transverse to the optical axis will degrade the resultant image. Thus lens carrier 120 is typically long along the optical axis so as to minimize any possible rotation about axes that are orthogonal to the optical axis of lens carrier 120 on slide 112 and ensure that the lens is maintained perpendicular to the optical axis. A disadvantage of this system is that the long contact length between the lens carrier 120 and slide 112 produces excess friction between the two and the movement of the carrier along the slide may be stiff and jerky and also exhibit excess hysteresis. The use of lubricants is problematic as an oily or greasy surface will attract dust and other contaminants which may jam the movement. A further problem is that any deviation in the straightness of rail 112 may cause a jamming of the movement of carrier 120.

FIG. 4 illustrates a further prior art arrangement which seeks to alleviate the friction and sticking problems exhibited by the system shown in FIG. 3. In this case the single long transverse hole in carrier 120 riding on rail 112 is replaced by two shorter segments with transverse holes 122. This arrangement is an improvement over the system shown in FIG. 3 in that it reduces overall friction however it fails to provide repeatable control over that friction. Further it is still prone to the problems involved with lubricants of the carrier and rail.

In prior art automated luminaire slide systems the manufacturers have been forced by operating conditions to provide additional mechanical means to provide a controlled amount of friction or dampening to the movement of the carrier on the rail in order to minimize hysteresis. Typically this takes the form of an adjustable spring loaded plunger (not shown) providing force onto the rail or a friction collar clamping on to the rail with an adjustable amount of force. Both these systems are prone to poor adjustment and drift in adjustment as the fixture ages and is maintained.

There is a need for an improved lens slide system for automated luminaire which provides controllable and repeatable friction or dampening in the movement of the lens.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGUREs, like numerals being used to refer to like and corresponding parts of the various drawings.

The present invention generally relates to an automated luminaire, specifically to the configuration and control of the linear movement of lenses within such a luminaire and discloses simplified means to provide a controlled and repeatable friction or dampening on the movement of such a lens without introducing an opportunity for jamming or sticking of the lens movement. While in the examples the slide system facilitates or guides the linear movement of lenses, the system is also contemplated to move other types of lighting or optical modulating or generating components in an automated luminaire.

Figure 1:
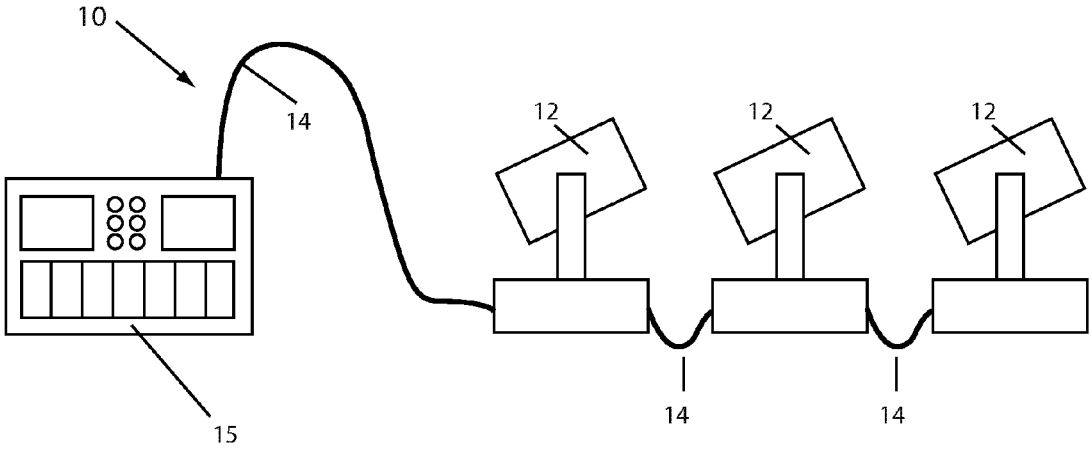
FIG. 1 illustrates a typical automated lighting system.
Figure 2:
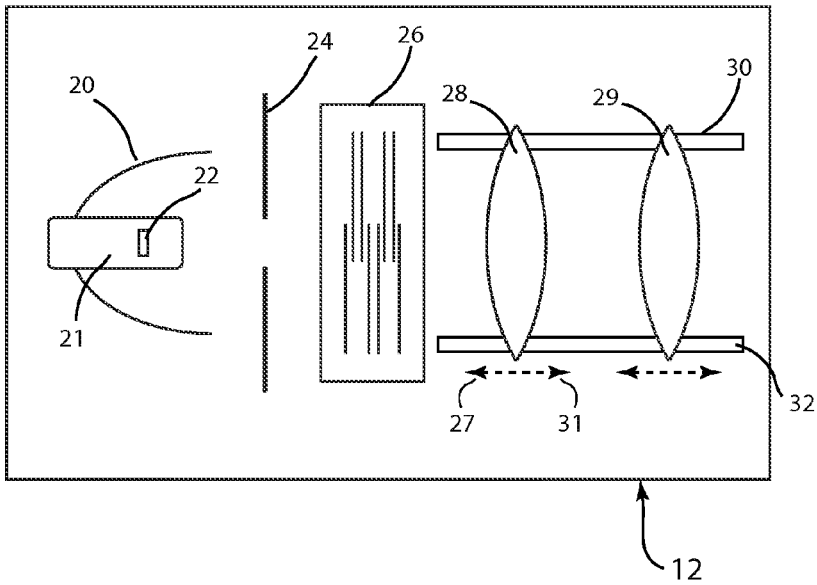
FIG. 2 illustrates a typical internal components of an automated luminaire.
Figure 3:
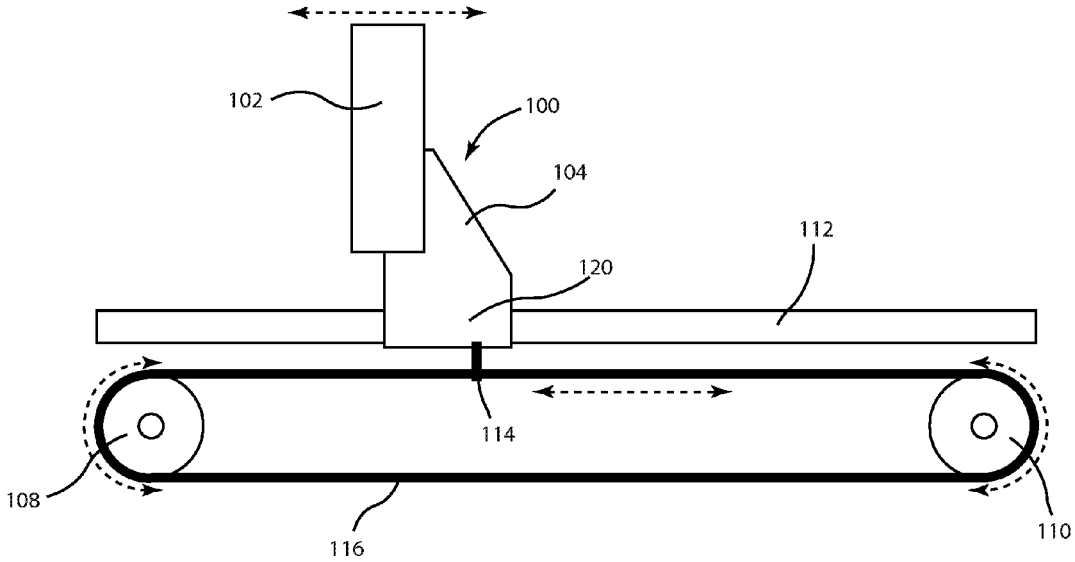
FIG. 3 illustrates a prior art slide rail system.
Figure 4:
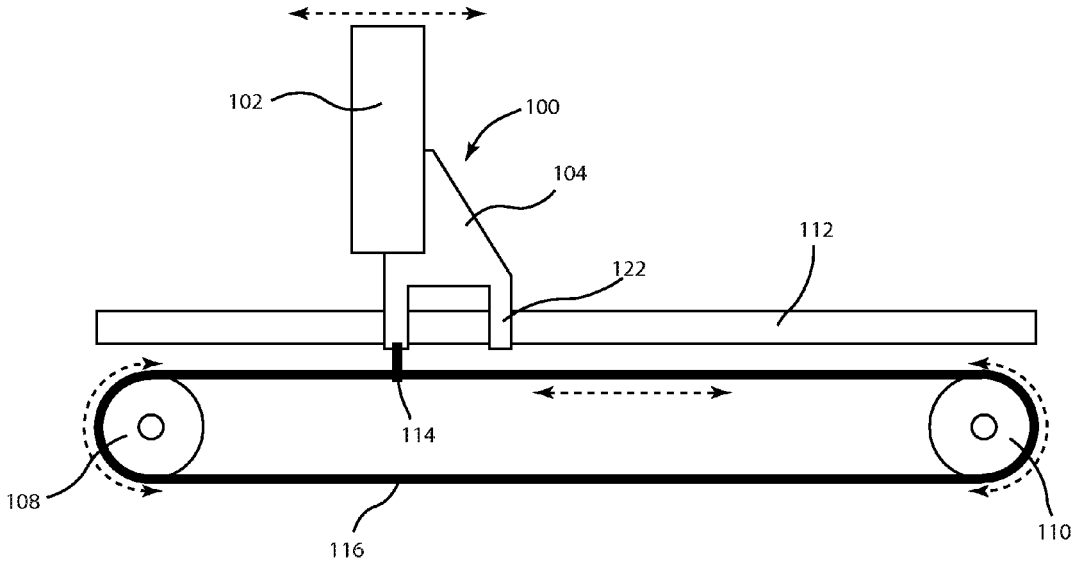
FIG. 4 illustrates a further prior art slide rail system.
Figure 5:
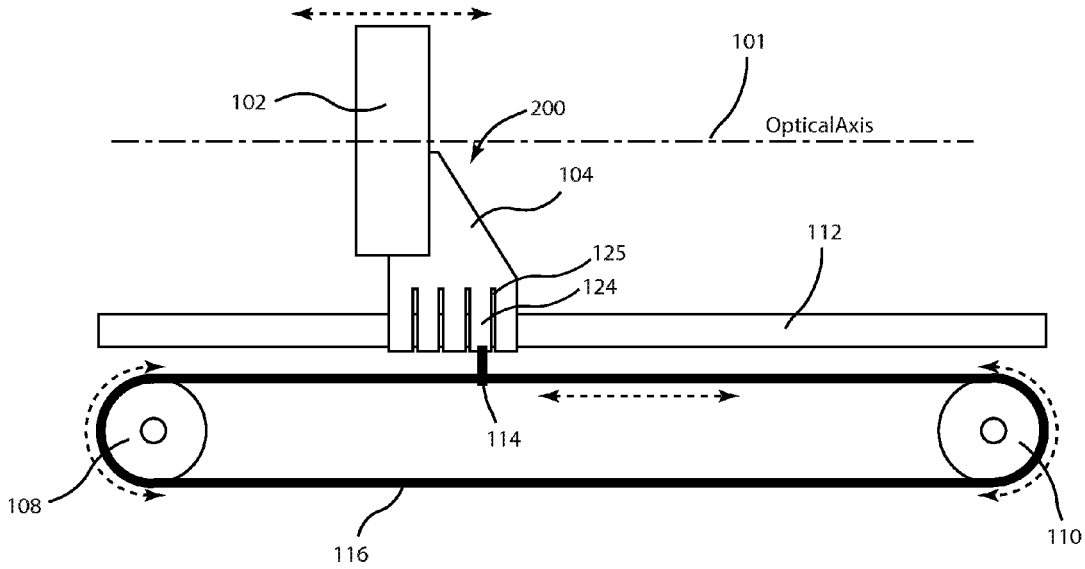
FIG. 5 illustrates a plan view of an embodiment of the invention.

FIG. 5 illustrates a plan view of an embodiment of the lens slide 200 invention used to control the movement of a lens assembly 100 along the optical axis 101 of an automated luminaire. Lens 102 is rigidly attached to a lens carrier 104. Lens carrier 104 rides on a rail 112 such that lens carrier 104 may slide along rail 112 and lens 102 may be positioned as desired along the optical axis through connection 114 with belt 116. Belt connection 114 is moved by the rotation of driven pulley 108 and runs on idler 110. Rail 112 may typically be round in cross section although other cross sections are possible as known in the art and the invention is not so limited. Although the illustrated system uses a belt drive to move the lens carrier the invention is not so limited and other movement systems well known in the art including but not limited to worm drives, shaft drives, gear drives, cam drives, linkage drives may be utilized without departing from the spirit of the invention. Different drive systems have different advantages and disadvantages with respect to speed, hysteresis, smoothness of motion, cost etc.

Carrier 104 comprises a series of fingers 124 formed by a series of parallel slots 125 in the carrier. Each of the fingers 124 has a transverse hole (127 in FIG. 7) that may be the same size, slightly smaller or slightly larger in diameter than rail 112. If hole 127 is larger than rail 112, as in the prior art, then friction between the rail and carrier will be low however the carrier will have freedom to move and will vibrate or wobble as the luminaire is moved. If hole 127 is the same size or smaller than rail 112 then hole 127 will grip rail 112 by the resilience of the carrier material acting as a spring, by adjusting the size of the hole and the resilience of the material the amount of this grip and thus the friction may be accurately controlled. The effective length of lens carrier 124 is long along the optical axis 101 and provides a wide support base which serves to minimize any possible rotation of lens carrier 124 on slide 112 while the slots 125 minimize any excessive contact area and allow for expansion and contraction during movement and during temperature changes within the luminaire 12. Thus the problems of excessive contact area such as jamming or sticking on uneven shafts and contaminant build up are avoided.

In some embodiments, to further reduce contaminant build up the lens carrier 124 may be manufactured of Nylon 66, PA66 or other similar self-lubricating material. The use of such material reduces the need for lubricant grease and thus removes the greasy surface which attracts dirt and contaminants.

Figure 6:
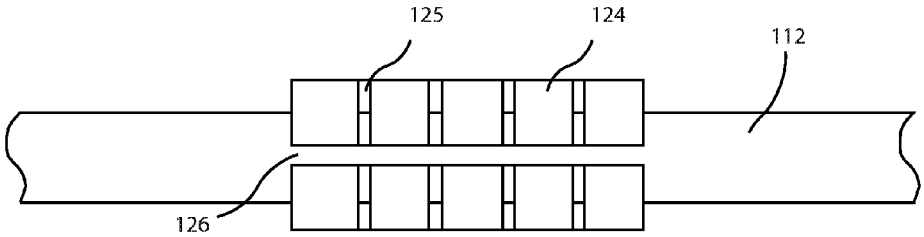
FIG. 6 illustrates an elevation view of the lens carrier slide.
Figure 7:
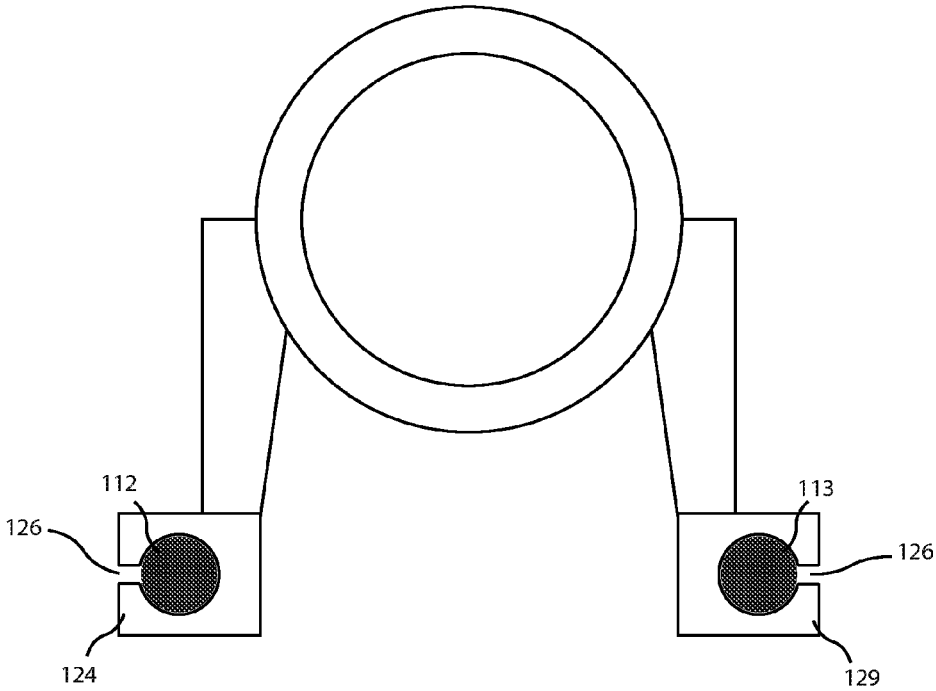
FIG. 7 illustrates a sectional view of the lens carrier slide.

FIG. 6 and FIG. 7 illustrate a further aspect of the invention—a longitudinal, slot(s) 126 running the length of the carrier 124 generally parallel to the optical axis. FIG. 6 shows carrier 124 from an elevation view perpendicular to the view in FIG. 5. FIG. 7 shows a sectional view through carrier 124 and rail 112. Carrier 124 runs on rail 112 and has a longitudinal slot 126 running along its axial dimension parallel to rail 112 and through all the fingers of carrier 124. In alternative embodiments these slots may be staggered between slots 125 rather than being in one line as illustrated in the figures.

Figure 8:
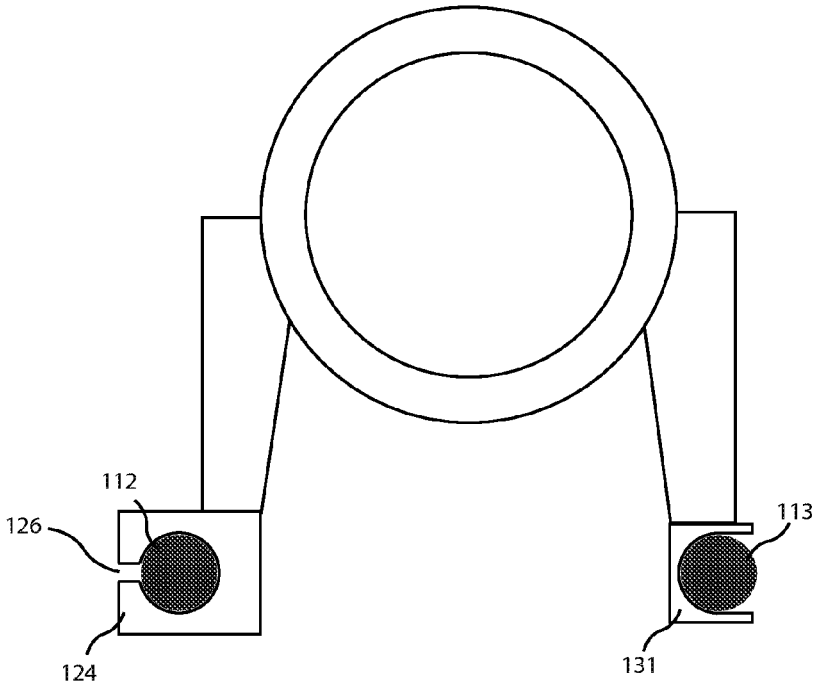
FIG. 8 illustrates a sectional view of a further embodiment of the lens carrier slide.

FIG. 7 further illustrates that that in this embodiment the slide system is a dual or multiple rail system. In some embodiments the rails 112 and 113 and interfaces 124 and 129 with the slide rails 112 and 113 respectively may be equivalent. In other embodiments as illustrated in FIG. 8 the second rail 113 and lens carrier interface 131 may be a looser fit that merely prevents rotation of the lens carrier and lens about the first slide rail 112 as the lens carrier or the luminaire itself is moved to different positions.

Carrier interface 124 may be manufactured of a resilient material such that the removal of material in slot 126 allows the fingers to act as springs gripping the rail 112 with a known and pre-defined force. In this case the diameter of the holes through the fingers in carrier 124 may be slightly smaller than the diameter of rod 112 and the slot 126 allows opening up those diameter against the resilience of the material acting as a spring so as to allow rail 112 to pass through the holes. This spring gripping action allows the fingers and thus carrier 124 to have a known and defined friction or dampening in their interaction with rail 112 without the need for any additional friction or dampening devices. Carrier 124 may further be molded to close tolerances so as to maintain a high accuracy on the grip and thus the friction between carrier 124 and rail 112. This accurate control of friction also ensures known and controllable hysteresis and thus good smooth movement and repeatability.

Figure 9:
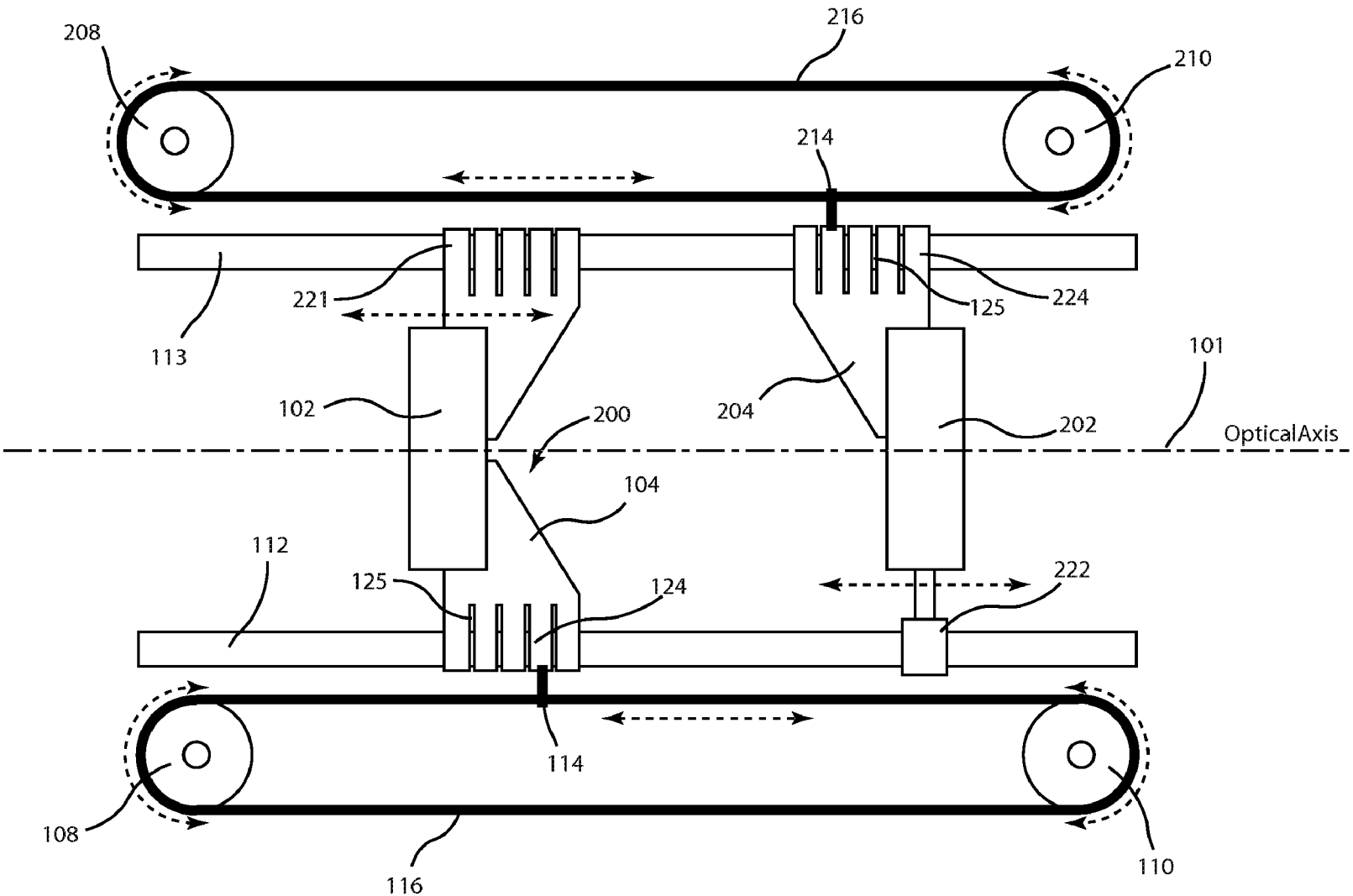
FIG. 9 illustrates a further embodiment of the invention.

A single lens and lens carrier is illustrated in FIGS. 5 and 6 however the invention is not so limited and, in practice, any number of lenses, carriers and rails may be used so as to provide the same advantages of controlled friction and dampening to a plurality of lenses. FIG. 9 illustrates a view of a further embodiment 200 of the invention where a first lens 102 and a second lens 202 are mounted to a first carrier 104 and a second carrier 204 each of which runs on their respective rails 112 and 113. Lens carriers 104 and 204 are manufactured with both the transverse slots 125 forming fingers 124, 224 providing a wide support base without excessive contact area and a longitudinal slot providing the controlled gripping action and thus a controlled friction and dampening.

Each carrier 104 and 204 has associated with it a second lens carrier interface 221 and 222 respectively which may run on a second rail to prevent rotation of the lens carrier and lens about the respective first rail. The first lens carrier 104 is driven by belt connection 114 which is driven by belt 116 which is driven by pulley 108. The second lens carrier 204 is driven by belt connection 214 which is driven by belt 216 which is driven by pulley 208.

In other embodiments lens carriers may share one or more guide rails.

Figure 10:
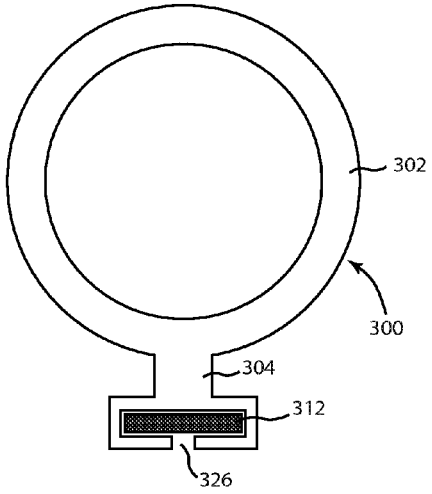
FIG. 10 illustrates a further embodiment of the invention employing a single slide rail.
Figure 11:
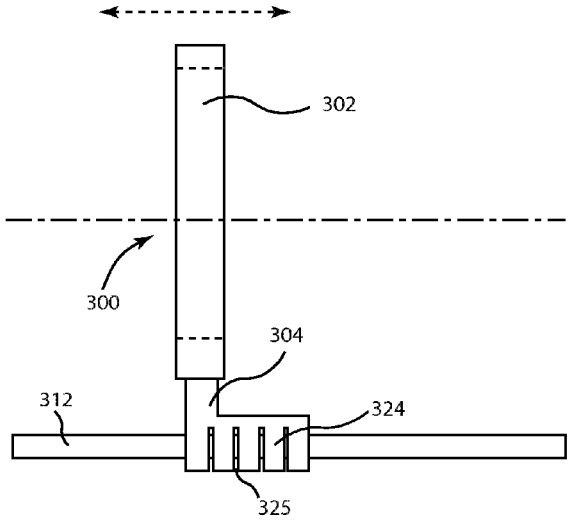
FIG. 11 illustrates a side view of the embodiment illustrated in FIG. 10.
Figure 12:
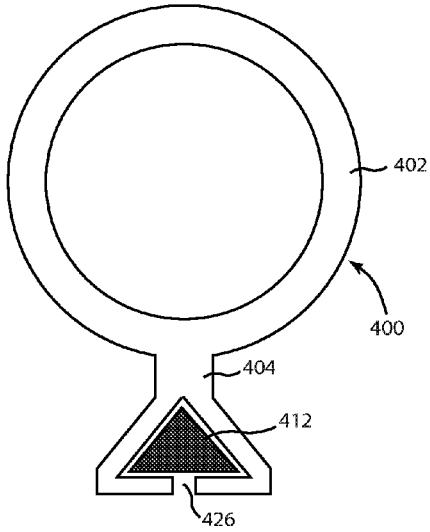
FIG. 12 illustrates a further embodiment of the single slide rail embodiment of FIG. 10 with a slide rail with another cross-sectional shape.

In yet further embodiments more than one lens and carrier may be positioned on a single rail. FIG. 10, FIG. 11 and FIG. 12 illustrate exemplar single rail embodiments. FIG. 10 illustrates an embodiment 300 with a slide rail 312 with a rectangular cross-section. The lens carrier 302 has longitudinal slot(s) 326 in the lens carrier's slide rail interface 304 can be seen in this view. FIG. 12 illustrates an embodiment of a lens carrier 402 with a slide rail 412 with a triangular cross section. The longitudinal slot(s) 426 in the lens carrier's slide rail interface 404 can be seen in this view. FIG. 11 illustrates a view from the side where the slots 325 and fingers 324 in the lens carrier interface 304 can be seen. In the embodiments 300 and 400 illustrated in FIG. 10, FIG. 11 and FIG. 12 additional slide rails are not necessary.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

I claim:

1. An automated luminaire with a light beam axis with light modulators mounted on a slide for positioning the light modulator along the light beam axis where the slide further comprises:

a carrier for the light modulator;

a slide rail for constraining the movement of the carrier; and an interface between the carrier and rail employing a plurality of slots which run vertically on the interface forming a plurality of fingers encircling the slide rails.

2. The automated luminaire of claim 1 at least on slot runs along the length of the carrier interface along the slide rail.

3. The automated luminaire of claim 1 where slot(s) separate individual finger from completely encircling the slide rail.

4. The automated luminaire of claim 1 where slide rails cross section is round.

5. The automated luminaire of claim 1 where the slide rail cross section is not round.

6. The automated luminaire of claim 1 where carrier is formed of a self-lubricating plastic.

7. The automated luminaire of claim 1 where the slide includes:

a plurality of slide rails; and a plurality of slide rail interfaces.

8. The automated luminaire of claim 1 where the slide includes a plurality of carriers for a plurality of light modulators.

9. An automated luminaire with a light beam axis with light modulators mounted on a slide for positioning the light modulator along the light beam axis where the slide further comprises:

a carrier for the light modulator;

a slide rail for constraining the movement of the carrier; and an interface between the carrier and slide rail comprising of a multitude of closely spaced fingers gripping the slide rail.

10. The automated luminaire of claim 9 where slide rails cross section is round.

11. The automated luminaire of claim 9 where the slide rail cross section is not round.

12. The automated luminaire of claim 9 where carrier is formed of a self-lubricating plastic.

13. The automated luminaire of claim 9 where the slide includes:

a plurality of slide rails; and a plurality of slide rail interfaces.

14. The automated luminaire of claim 9 where the slide includes a plurality of carriers for a plurality of light modulators.

* * * * *